US005316254A

United States Patent [19]

McCartha

[11] Patent Number: 5,316,254

[45] Date of Patent: May 31, 1994

[54] JUNCTION BOX SUPPORT FOR SUSPENDED CEILINGS

[76] Inventor: Robert D. McCartha, 268 Sid Bickley Rd., Chapin, S.C. 29036

[21] Appl. No.: 882,884

[22] Filed: May 14, 1992

[51] Int. Cl.[5] ..... B42F 13/00

[52] U.S. Cl. ..... 248/343; 248/906

[58] Field of Search ..... 248/342–344, 248/906, 57

[56] References Cited

U.S. PATENT DOCUMENTS

| | | | |
|---|---|---|---|
| 2,642,241 | 6/1953 | Pryne | 248/343 |
| 3,039,729 | 6/1962 | Nagle, Sr. | 248/343 |
| 3,228,645 | 1/1966 | Zurawski et al. | 248/343 |
| 3,312,816 | 4/1967 | Muller et al. | 248/343 |
| 3,352,071 | 11/1967 | Sutter | 52/28 |
| 3,597,889 | 8/1971 | LoNigro | 52/28 |
| 3,912,865 | 10/1975 | Seebinger | 248/343 |
| 4,041,657 | 8/1977 | Schuplin | 52/39 |
| 4,114,327 | 9/1978 | Williams | 52/28 |
| 4,149,693 | 4/1979 | LoNigro | 248/342 |
| 4,406,216 | 9/1983 | Hott et al. | 248/343 X |
| 5,029,794 | 7/1991 | Wolfe | 248/343 |

*Primary Examiner*—Alvin C. Chin-Shue
*Attorney, Agent, or Firm*—Michael A. Mann

[57] ABSTRACT

Supports for a junction box in a suspended ceiling. Two supports comprised of two, four-sided pieces of metal the length of a ceiling panel are secured to the suspended ceiling frame and to the sides of a junction box so that the junction box is held in position securely. The support also resists upward movement of the ceiling panel so that it does not rise when the light fixture is fastened to the junction box.

8 Claims, 2 Drawing Sheets

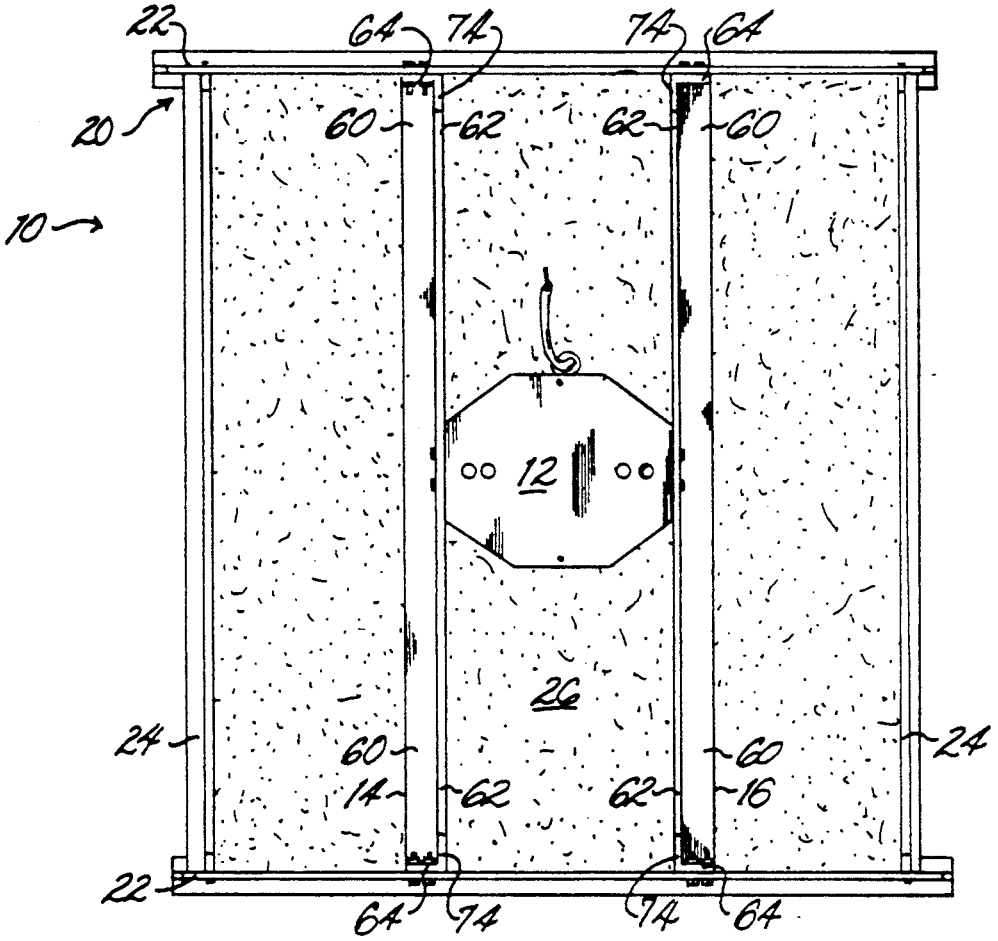
Fig. 3
Fig. 4
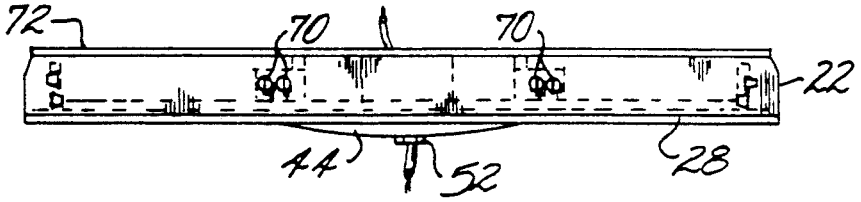

JUNCTION BOX SUPPORT FOR SUSPENDED CEILINGS

BACKGROUND OF THE INVENTION

1. Field of the Invention

The present invention relates to supports for junction boxes for use in hanging light fixtures and the like from suspended ceilings.

2. Discussion of Background

A suspended ceiling is a "false" ceiling comprising a framework hung from the "true" ceiling and a number of panels carried and supported by the framework. The framework is formed of a matrix of interlocking sections that define spaces, usually rectangular, that support the panels, preferably acoustical panels. A suspended ceiling is an inexpensive and effective way of concealing wiring, ductwork, and piping between it and the true ceiling. It also enables wiring, etc. to be run after the ceiling is installed with minimum disruption and effort since the panels are easily lifted to permit access to the region thereabove.

There are a number of articles for supporting light fixtures and junction boxes of one sort or another in a suspended ceiling. Typically these articles have one or two supports that run beyond length of the panel to straddle the frame. Representative of these are the supports as shown and described in U.S. Pat. Nos. 4,169,693 and 3,597,889 issued to LoNigro and in U.S. Pat. No. 4,114,327 issued to Williams and U.S. Pat. No. 3,352,071 issued to Sutter.

Typically, these supports hold the junction box at a height where the bottom of the box is flush with the bottom of the panel, but there is no structure provided by these supports to hold the panel down when the light fixture is tightened to the junction box. This tightening tends to push the panel up until it meets resistance, resulting in a junction box extending below the panel. Moreover, all of these supports extend beyond the panel by straddling the frame. When the adjacent panel is pushed up to gain access to the area above the suspended ceiling, the supports interfere with and mar the edges of the raised panel.

SUMMARY OF THE INVENTION

According to its major aspects and broadly stated, the present invention is an article for use with a suspended ceiling having a frame and panels supported by the frame. In particular, the article is used in the installation of a junction box. A junction box is a receptacle that has sides, a closed end and an open end for use in bringing electrical wiring into a light fixture or other electrical device. The junction box may have several holes in it through which the wires enter the otherwise closed end of the box.

The article comprises two supports, both four-sided and having two sides substantially the length of the panel but no longer so that they just reach the insides of the frame holding the panel. The supports each have one side that engages the top surface of the panel and another side perpendicular to the first for engaging the side of the junction box. The third and fourth side is perpendicular to the first two, parallel to each other and engage the frame. The second side is attached to the side of the junction box, preferably by self-tapping screws. The third and fourth sides are attached to the frame, again preferably by self-tapping screws.

An important feature of the present invention is the two support members. Since they are attached to the junction box and to the frame, they hold the junction box in alignment with the frame so that it extends below the frame only as much as desired. Usually the open end of the junction box is flush with the bottom of the frame. Also, because the first side engages the top surface of the panel and the frame supports the bottom surface of the panel, the panel is therefore held firmly in place between them, and will not move when a light fixture is secured to the junction box. Thus the supports have two functions: they hold the junction box in the right position with respect to the panel and they provide resistance to upward movement of the panel when the light fixture is being attached.

Another important feature of the present invention is that it is completely confined within the interior of one panel-sized section of frame. The corners of the second side are preferably angled and the third and fourth sides are shorter than the second side so that no part of the supports interferes with the frame or straddles the frame. Therefore, the adjacent panels can be raised without being marred by the supports.

Another important feature of the present invention is its simple construction and installation. It is two, easily-made, four-sided pieces of metal that can be installed quickly and securely using self-tapping screws and a power tool. The supports are positioned in spaced-apart relation to accommodate any size junction box.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 3 is a top plan view of the article as shown in FIG. 1; and

FIG. 4 is an end elevation of the article shown in FIG. 1.

DETAILED DESCRIPTION OF A PREFERRED EMBODIMENT

Figure 1:
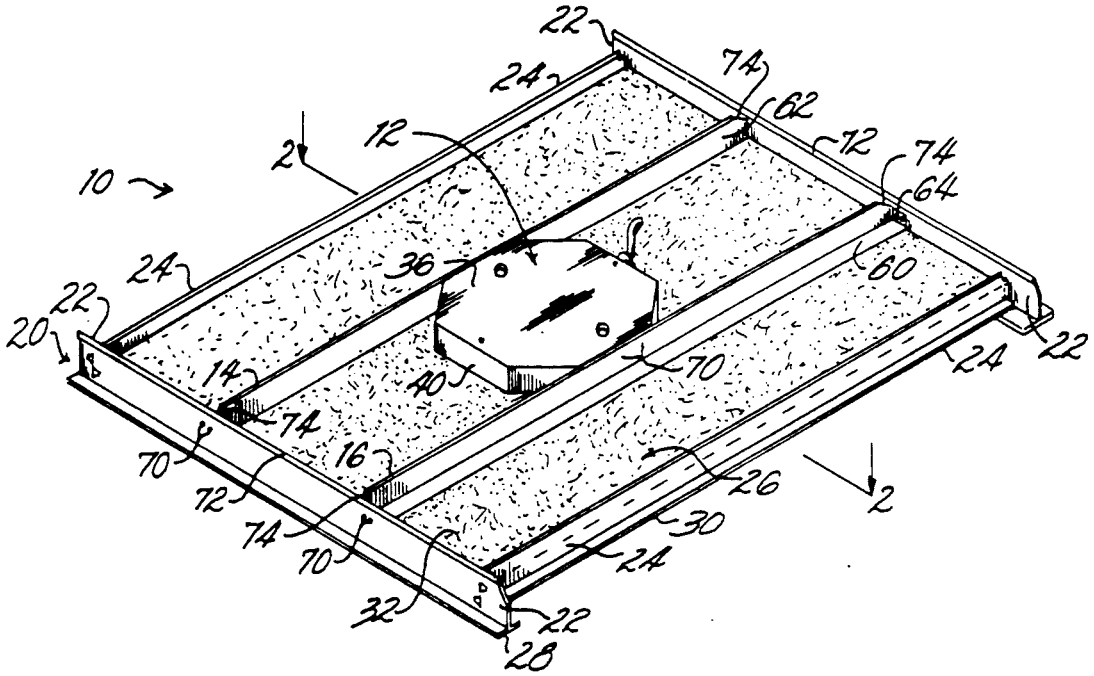
FIG. 1 is a perspective view of an article according to a preferred embodiment of the present invention shown in use with a suspended ceiling.
Figure 2:
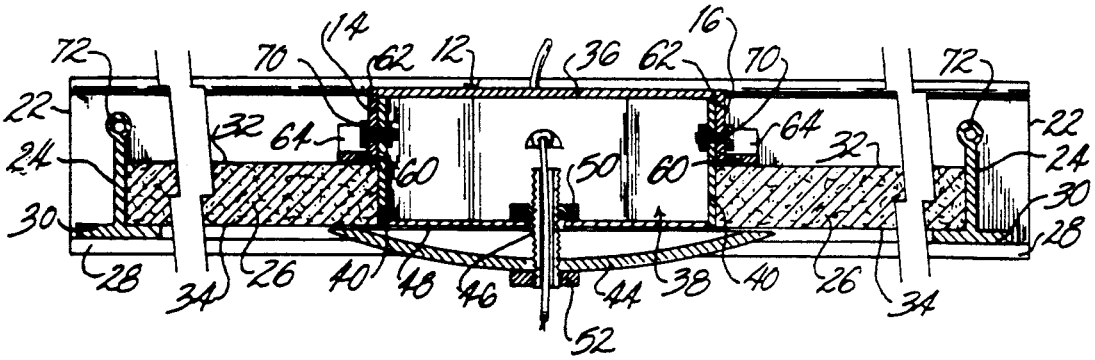
FIG. 2 is a side cross-sectional view of the article of FIG. 1 taken across lines 2—2.

Referring now to FIGS. 1–4, there is illustrated a portion of a suspended ceiling 10 as seen from above the ceiling. In the particular portion of suspended ceiling 10 shown is a junction box 12. Holding junction box 12 is the present invention: a first support 14 and a second support 16.

Suspended ceiling 10 comprises a frame gridwork 20 made of a interlocking matrix of end frames 22 and side frames 24; that is, an end frame 22 interlocks with a side frame 24 to form gridwork 20 and to thereby define spaces wherein panels such as panel 26 can be placed. End frames 22 and side frames 24 have generally inverted "T" shaped cross sections with a flanged base 28, 30 respectively. Suspended ceilings, junctions boxes and panels are not part of the present invention.

Panels have a top surface 32 and bottom surface 34. Bottom surface 34 is supported by end frames 22 and side frames 24. Panel 26 is supported from below by flanged bases 28, 30.

Panel 26 has a hole cut in it for junction box 12. A junction box is a partially open receptacle for bringing electrical wiring to a light fixture that will be hung from the ceiling. Junction box 12 is usually made of metal and has a closed top 36, an open bottom 38 and closed sides 40. Holes 42 may be made in top 36 and sides 40 for electrical wires to pass therethrough, as required. Junction box 12 is preferably mounted so that the open bottom 38 is flush with 26 panel through which it projects. A decorative cover 44 is secured to junction box 12 via a hollow threaded stem 46, a transverse bar 48 and two nuts 50, 52. A light fixture (not shown) is threaded to stem 46 until it meets resistance when panel 26, pushed up by decorative cover 44, is stopped from above.

First and second supports 14, 16 lie adjacent side 40 of junction box 12 when junction box 12 is centered in the hole in panel 26 at the right elevation. Each support 14, 16 comprises a piece of metal or other rigid material having a first side 60, a second side 62 a third side 64 and a fourth side 66. Sides 60, 62 are substantially the length of panel 26 so that supports 14, 16 can be attached to the inside of end frames 26, since panel 26 just fits inside frame gridwork 20 and does not extend beyond its confines. Side 60 engages the top side 32 of panel 26; side 62 engages a side of the junction box. Sides 64, 66 engage end frames 22. When sides 64, 66 of the supports 14, 16 are attached to end frames 22 and sides 62 of supports 14, 16 are attached to junction box 12, supports 14, 16 and junction box 12 are then fixed in place with respect to frame gridwork 20. Panel 26 is thus held between the sides 60 of supports 14, 16 and flanged bases 28, 30 of frame gridwork 20 so that it cannot move with respect to suspended ceiling 10. Junction box 12 is thus held at the appropriate level with respect to panel 26.

In use, a hole is first cut into panel 26. Supports 14, 16 are placed on either side of the hole, with junction box 12 held therebetween so that supports 14, 16 can be moved adjacent to and in engagement with sides 40 of box 12. Then sides 64, 66 of supports 14, 16 are clamped to frame gridwork 20. Junction box 12 is then attached to supports 14, 16 by screws, bolts, or, preferably, self-tapping screws 70 that are put into place with a power screw driver. After junction box 12 is secured, supports 14, 16 are screwed or bolted to end frames 22 and the clamps removed.

Each support 14, 16 is best made of a single piece of steel cut to length and shaped for a standard ceiling panel 26 and frame gridwork 20. For supporting most light fixtures, 24 gage steel is sufficient; for heavier fixtures, ceiling fans for example, a heavier gage such as 20 gage is preferred. First and second sides 60, 62 should be just long enough to reach from one end frame 22 to the other so that sides 64, 66 can be attached thereto easily without bending end frames 22. Ends 74 of the side 62 are preferably angled or curved so that they do not interfere with a bead 72 of end frames 22 when put into position. Furthermore, sides 64, 66 are shorter than side 62 for the same reason as side 62 is angled, namely, to avoid bead 72.

It will be apparent to those skilled in the art that many changes and substitutions can be made to the preferred embodiment herein described without departing from the spirit and scope of the present invention as defined by the appended claims.

What is claimed is:

1. An article for use with a suspended ceiling having a frame and panels carried by said frame, said panels having an upper surface and a lower surface, said lower surface of said panels engaging said frame, at least one panel of said panels having a hole in it, and for use with a junction box, said hole in said at least one panel dimensioned to receive said junction box, said article comprising:

a pair of supports, each support dimensioned to run substantially the length of a panel but no longer, each support having means formed therein for holding a panel in engagement with said frame, said holding means having a face engaging said upper surface of said at least one panel substantially along its entire length and extending across said panel to hold said at least one panel between said holding means and said frame, and first means formed therein for engaging said frame so that said support can be attached to said frame and second means formed therein for engaging said junction box so that said support can be attached to said junction box, said face of said holding means preventing upward movement of said panel with respect to said junction box when said supports are attached thereto and said panel is lifted.

2. The article as recited in claim 1, further comprising means for attaching said first and second engaging means to said frame and said junction box, respectively.

3. The article as recited in claim 1, wherein said holding means is a first side, said first engaging means is a second side perpendicular to said first side, and said second engaging means is a third side perpendicular to said first and said second sides.

4. An article for use with a suspended ceiling having a frame and panels carried by said frame and for use with a junction box, said panels having an upper surface and a lower surface, said frame engaging said lower surface of said panels to support said panels, said junction box for operating through a hole in one of said panels and open from said lower surface of said one panel, said article comprising:

a pair of supports, each support dimensioned to run substantially the length of a panel but not longer, each support having means formed therein for holding a panel in engagement with said frame and first means formed therein for engaging said frame so that said support can be attached to said frame and second means formed therein for engaging said junction box so that said support can be attached to said junction box, said holding means having a face engaging said upper surface of said panel substantially along its entire length and extending across said panel to hold said panel between said holding means and said frame; and means for attaching said supports to said frame and said junction box, said face of said holding means preventing upward movement of said panel with respect to said junction box when said supports are attached thereto and said panel is lifted.

5. The article as recited in claim 4, wherein said attaching means further comprises self-tapping screws.

6. The article as recited in claim 4, wherein said holding means further comprises a first side, said first engaging means further comprises a second side attached at right angles to said first side, and said second engaging means further comprises a third side attached at right angles to said first and said second sides.

7. A method of installing a junction box in a suspended ceiling, said suspended ceiling having a frame and panels supported by said frame, said method comprising:

forming a hole in a panel of said suspended ceiling, said hole just larger than said junction box;

placing a first support having three sides, one of said three sides being substantially the length of said panel, on said panel and adjacent said hole so that said one side of said first support engages said panel substantially along its entire length;

clamping said first support to said frame;

placing a second support having three sides, one of said three sides of said second support being substantially the length of said panel on said panel and adjacent said hole opposite said first support so that said one side of said second support engages said panel substantially along its entire length;

clamping said second support to said frame;

fastening said first support to the side of said junction box, said junction box being held in said hole in said panel;

fastening said second support to the opposing side of said junction box;

fastening said first support to said frame; and fastening said second support to said frame.

8. The method as recited in claim 7, wherein said first and second supports are fastened to said junction box and to said frame with self tapping screws.

* * * * *